US006742299B2

(12) United States Patent
Strand

(10) Patent No.: US 6,742,299 B2
(45) **Date of Patent: *Jun. 1, 2004**

(54) LASER DEVICE FOR USE IN ADJUSTING A FIREARM'S SIGHT

(75) Inventor: Jan Strand, Phoenix, AZ (US)

(73) Assignee: Strandstar Instruments, L.L.C., Escondido, CA (US)

( * ) Notice: Subject to any disclaimer, the term of this patent is extended or adjusted under 35 U.S.C. 154(b) by 480 days.

This patent is subject to a terminal disclaimer.

(21) Appl. No.: 09/783,687

(22) Filed: Feb. 14, 2001

(65) Prior Publication Data

US 2001/0042335 A1 Nov. 22, 2001

Related U.S. Application Data

(63) Continuation-in-part of application No. 09/317,586, filed on May 24, 1999, now Pat. No. 6,216,381.

(51) Int. Cl.[7] ..... F41G 1/34
(52) U.S. Cl. ..... 42/134; 42/116; 33/234
(58) Field of Search ..... 42/116, 134; 33/234, 33/241

(56) References Cited

U.S. PATENT DOCUMENTS

| | | | | |
|---|---|---|---|---|
| 3,782,832 A | | 1/1974 | Hacskaylo | 356/153 |
| 4,481,561 A | | 11/1984 | Lanning | 362/111 |
| 4,530,162 A | | 7/1985 | Forrest et al. | 33/228 |
| 4,761,907 A | | 8/1988 | DeBernardini | 42/106 |
| 4,825,258 A | | 4/1989 | Whitson | 356/153 |
| 4,830,617 A | | 5/1989 | Hancox et al. | |
| 4,879,814 A | | 11/1989 | Wallace et al. | 33/234 |
| 5,001,836 A | | 3/1991 | Cameron et al. | 33/234 |
| 5,241,458 A | | 8/1993 | Abbas | 42/103 |
| 5,351,429 A | | 10/1994 | Ford | 42/103 |
| 5,365,669 A | | 11/1994 | Rustick et al. | 33/234 |
| 5,432,598 A | | 7/1995 | Szatkowski | 356/153 |
| 5,446,535 A | | 8/1995 | Williams | 356/153 |
| 5,454,168 A | | 10/1995 | Langner | 33/234 |
| 5,488,795 A | | 2/1996 | Sweat | 42/103 |
| 5,531,040 A | | 7/1996 | Moore | 42/103 |
| 5,685,106 A | | 11/1997 | Shoham | 42/103 |
| 5,787,631 A | | 8/1998 | Kendall | 42/103 |
| 5,909,951 A | | 6/1999 | Johnsen et al. | 362/111 |
| 6,068,484 A | | 5/2000 | O'Loughlin et al. | 434/22 |
| 6,151,788 A | * | 11/2000 | Cox et al. | 33/286 |
| 6,216,381 B1 | * | 4/2001 | Strand | 42/113 |
| 6,389,730 B1 | * | 5/2002 | Millard | 42/116 |

* cited by examiner

*Primary Examiner*—J. Woodrow Eldred
(74) *Attorney, Agent, or Firm*—Quarles & Brady Streich Lang; Paul D. Amrozwicz, Esq.

(57) ABSTRACT

A device facilitates adjustment of a sight on each of a variety of firearms having different calibers by providing a visible mark on a target when the device is placed within a chamber of any of the firearms. The device includes a housing, and a laser module energizeable within the housing to produce the mark at a position along a laser axis extending through the firearm's barrel. An outer sleeve fits snugly around at least a portion of the housing, and has an external shape sized to fit snugly within a chamber of predetermined caliber for one of the firearms. A power supply situated either within the housing or within the sleeve electrically energizes the laser module.

12 Claims, 3 Drawing Sheets

LASER DEVICE FOR USE IN ADJUSTING A FIREARM'S SIGHT

CROSS-REFERENCE TO RELATED APPLICATIONS

The present application is a continuation-in-part of U.S. application Ser. No. 09/317,586, filed May 24, 1999, now U.S. Pat. No. 6,216,381.

STATEMENT REGARDING FEDERALLY SPONSORED RESEARCH OR DEVELOPMENT

Not applicable.

BACKGROUND OF THE INVENTION

The present invention relates to devices and techniques for accurately positioning the sight of a firearm, and more particularly deals with in-bore laser devices and methods of using such devices to improve the positioning accuracy of a firearm's sight.

Use of sights for aiming firearms, such as rifles and pistols, is well known. Ideally, when a firearm's scope is properly adjusted, the projectile shot from the firearm will strike the target at a known position identified through visual alignment with a feature of the scope, such as the intersection of scope cross-hairs. Understandably then, those with skill in the art desire efficient techniques for accurately positioning a firearm's sight.

U.S. Pat. No. 5,787,631 ("'631 patent") issued to Kendall discloses an array of prior techniques for use in aligning firearm sights. For example, the '631 patent discloses a technique in which a series of rounds are shot at a target, each followed by comparison between the anticipated target spot as viewed through the sight and the corresponding actual striking location for the given round. The comparisons were used to refine the position of the firearm sight. Presumably, this "trial and error" approach is time consuming, and wastes ammunition.

The '631 patent also discloses a group of laser-based techniques for aligning a firearm sight, and in particular, focuses on U.S. Pat. No. 5,365,669 ("'669 patent") issued to Rustick et al. The '631 patent identifies a problem with the '669 patent approach, and proposes a solution therefor. Specifically, one of the main problems associated with the '669 patent was that the laser beam emitted from the laser module would likely fail to clear the bore of the rifle, unless suitable laser alignment was provided.

In response, the '631 patent proposed using set screws to facilitate laser module alignment. Specifically, the '631 patent disclosed a housing including a threadedly engaged inner sleeve, which contains a laser module and a battery. Four set screws penetrate the housing to facilitate movement of the laser module, presumably into a properly aligned position. Additionally, the '631 patent discloses the use of a spring-based switch mechanism to operate the laser module. Specifically, when the '631 device is inserted into a firearm and the firearm's bolt is engaged, the force of the bolt closes the switch mechanism to activate the laser module.

Though the '631 patent asserts to have overcome certain shortcomings of the prior art, it too has limitations. For example, using four set screws to align the laser module is a cumbersome and time consuming task. Each time the user makes an adjustment, one set screw is tightened, and an opposing set screw must be loosened to permit free motion for the laser module. Moreover, with each adjustment of the laser module, the user has to evaluate its effectiveness in planning the next adjustment. The process is inherently complex as it involves coordinated adjustments along multiple axes of motion for the laser module.

Another problem affiliated with the '631 patent resides in the switch mechanism. Pressing the switch 8 at that back of the '631 device energizes the laser module. This can be carried out when the device is loaded into a firearm, as desired, due to the force of the firearm's engaged bolt. Similarly, the laser module can be activated when the '631 device is out of the firearm, as pressing switch 8 energizes the laser module regardless of whether the device is or is not located within the firearm. Thus, a user can prematurely drain the device's battery by inadvertently closing switch 8 by, for example, putting the device in a coat pocket. Switch 8 poses yet another problem, namely, that it incorporates movable components subject to eventual inoperability due to normal wear and tear.

There therefore was a need for an improved laser device for use in adjusting a firearm's sight, and a method for aligning a laser module that overcome the limitations of prior devices and techniques.

BRIEF SUMMARY OF THE INVENTION

The present invention concerns a device facilitating adjustment of a sight on each of a variety of firearms having different calibers by providing a visible mark on a target when the device is placed within a chamber of any of the firearms. The device includes a housing, and a laser module energizeable within the housing to produce the mark at a position along a laser axis extending through the firearm's barrel. An outer sleeve fits snugly around at least a portion of the housing, and has an external shape sized to fit snugly within a chamber of predetermined caliber for one of the firearms. A power supply situated either within the housing or within the sleeve electrically energizes the laser module.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

DETAILED DESCRIPTION OF THE INVENTION

Figure 7:
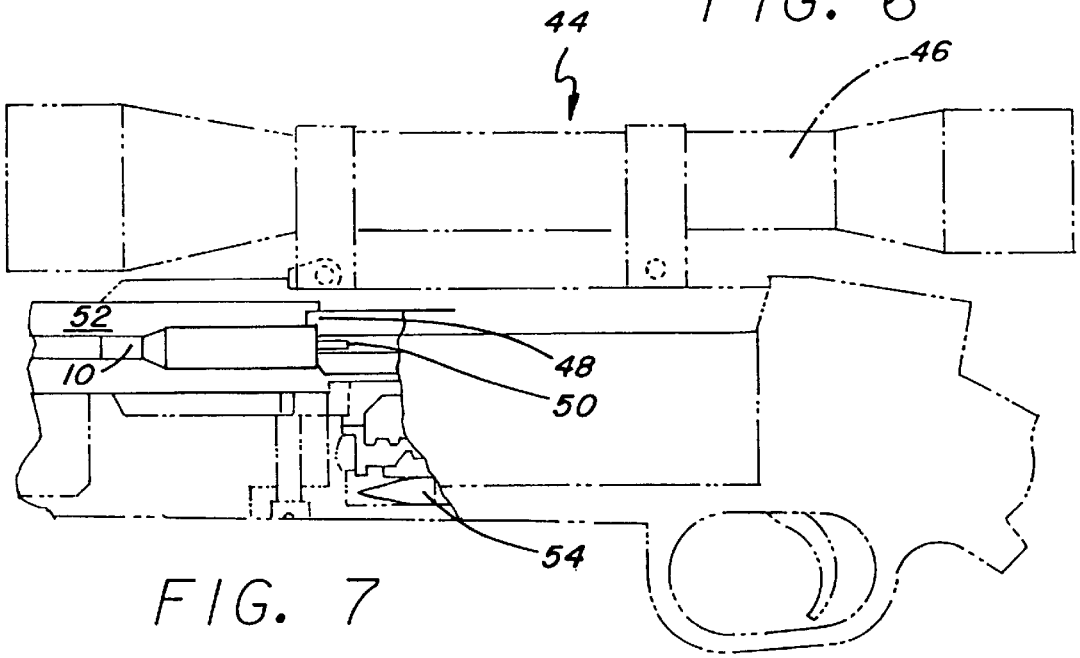
FIG. 7 is a partial perspective view of a firearm and scope with portions broken away to show the device of FIG. 2.

Referring now to the drawings, wherein like reference characters represent corresponding elements throughout the several views, and more specifically referring to FIG. 7, device 10 of the present invention is shown within firearm 44.

Firearm 44 is shown in the "locked and loaded" condition, a state well known to those skilled in the art. Portions of FIG. 7 are shown broken away to reveal firearm internals including a bolt head 48, a firing pin 50, and a barrel 52. Device 10 is situated within a chamber of firearm 44 where a round typically resides prior to firing, though device 10 cannot be fired. Additionally, one of several reserve rounds 54 is also shown, but typically no actual rounds 54 are loaded when device 10 is being used to facilitate sight adjustment.

Here, firearm 44 is a rifle, though those skilled in the art understand that device 10 and its associated methodology could be used with any type of firearm including a rifle, a hand gun, a machine gun, or the like. Similarly, firearm 44 includes a scope 46, but those skilled in the art understand the device 10 and the related methodology could be used with any type of firearm scope, sight, or the like.

Figure 2:
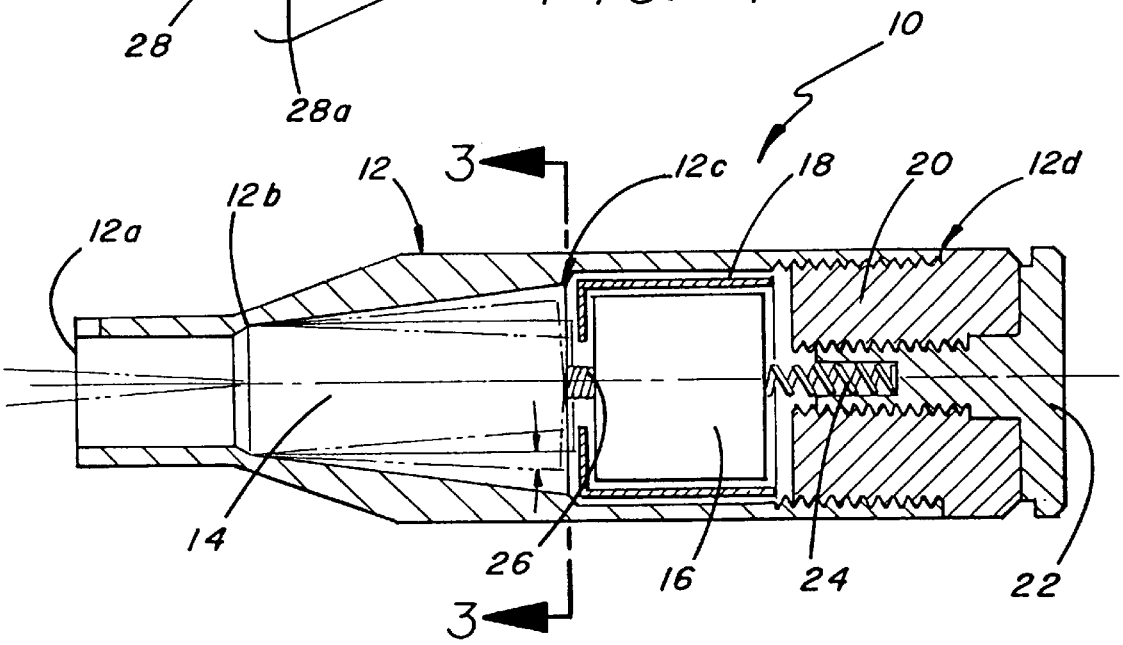
FIG. 2 is a diametric cross-sectional view of the device of the present invention.

Referring to FIG. 2, device 10 includes housing 12 containing laser module 14 and power supply 16. The external shape of device 10 resembles the external shape of round 54 (see FIG. 7), though unlike round 54, device 10 does not contain a bullet. More generally, the external shape of device 10 will resemble the external shape of a round of appropriate caliber for shooting from the firearm, whatever be the caliber and type of the firearm, though device 10 typically will not include a bullet.

By way of example, the external configuration of housing 12 comprises various sections from front to back. A front tubular section extends from front opening 12*a* to position 12*b*. From position 12*b* to a location in between locations 12*b* and 12*c*, the outer diameter of housing 12 increases providing a conically-shaped section. At a point in between locations 12*b* and 12*c*, the increase in outer diameter of the conically-shaped section stops, and a tubular section having a very slight (not visible in FIG. 2) increase in outer diameter extends to the back end 12*d* of housing 12.

Front-end opening 12*a* permits laser beam passage, while the opposite end of housing 12 also includes an opening, typically closed when device 10 is assembled. More specifically, a back-end insulator 20 is threadedly engaged with housing 12. Back-end insulator 20 is tubular and includes a central cavity with internal threads for receiving back-end cap 22, which has a T-shaped cross-section. The shaft of back-end cap 22 includes a recess for receiving a spring 24, which makes contact with power supply 16 when device 10 is assembled.

Housing 12, back-end insulator 20, and back-end cap 22 are each manufactured using well known techniques. The material used to make housing 12 and back-end cap 22 is brass, or any other rigid conductive material; however, back-end insulator 20 is made with a rigid material that is, at least in part, non-conductive. For example, back-end insulator 20 may be entirely made from non-conductive material, like plastic. Alternatively, back-end insulator 20 may be made from a conductive material, such as aluminum, with an outer layer completely anodized using a non-conductive material. In yet another alternative, insulator 20 may be made with a conductive material having selected outer surface portions anodized with non-conductive material.

In sum, housing 12, back-end cap 22, and spring 24 are conductive, while back-end insulator 20 (or at least selected outer surface portions thereof) is non-conductive. Accordingly, an open circuit is established by back-end insulator 20, regardless of its manner of construction, in the electrical flowpath in between power supply 16 and housing 12.

Power supply 16 comprises one or more batteries providing sufficient power to operate laser module 14. Presently, a series pair of button batteries is used providing a combined voltage of 3.0–4.5 volts, though any one of a number of well known power supplies may be used. Moreover, if a different laser module 14 were used (having different power needs), then alternative power supply arrangements may be used.

Power supply 16 makes electrical contact with springs 24 and 26. Specifically, the negative electrode of power supply 16 contacts spring 26, in electric communication with laser module 14, and the positive electrode of power supply 16 contacts spring 24, in electric communication with back-end cap 22. However, back-end insulator 20 prevents completion of the flowpath from back-end cap 22 to housing 12, which is in electric communication with laser module 14. Thus, laser module 14 does not operate until an electrically conductive flowpath is established in between back-end cap 22 and housing 12.

When power supply 16 (e.g., button batteries) does not include its own outer insulating layer, insulator 18 is included. This prevents power supply 16 from making direct electrical contact with the interior surface of housing 12 or with laser module 14 (other than through spring 26), which would activate laser module 14. Insulator 18 includes a tubular section, which electrically isolates power supply 16 from the interior surface of housing 12, and a lip inserted in between power supply 16 and laser module 14 for similar purpose. Insulator 18 may be made from plastic or any other rigid insulating material.

The transitional region of insulator 18, between its tubular section and lip, rests against a mechanical stop provided by an inner surface of housing 12 which begins to taper inward at location 12*c*. The mechanical stop prevents contact in between power supply 16 and laser module 14, other than through spring 26. If power supply 16 is itself provided with an outer insulating layer, then use of insulator 18 for electrical isolation would be redundant.

Figure 3:
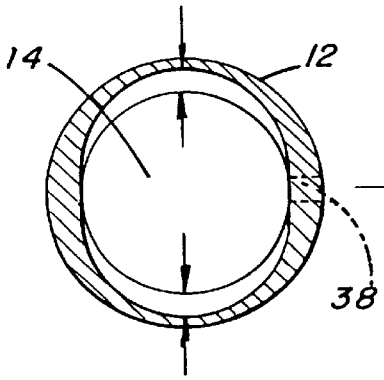
FIG. 3 is a view taken along line 3—3 of FIG. 2, but showing the device in full cross-section.

In between locations 12*c* and 12*b*, the inner diameter of housing 12 is tapered. Moreover, the inner diameter of housing 12 at location 12*b* is such that it provides another mechanical stop, this one for the front edge of laser module 14. FIG. 3 shows how laser module 14 resides within an internal cavity of housing 12. Specifically, opposing outer surfaces of laser module 14 make contact with opposing interior surfaces of housing 12. A cross section of the cavity in FIG. 3 containing laser module 14 is generally elliptical, permitting substantially one axis of motion for laser module 14 within housing 12, namely up and down as viewed in FIG. 3. An aperture 38 is provided through housing 12 permitting access to laser module 14.

Figure 1:
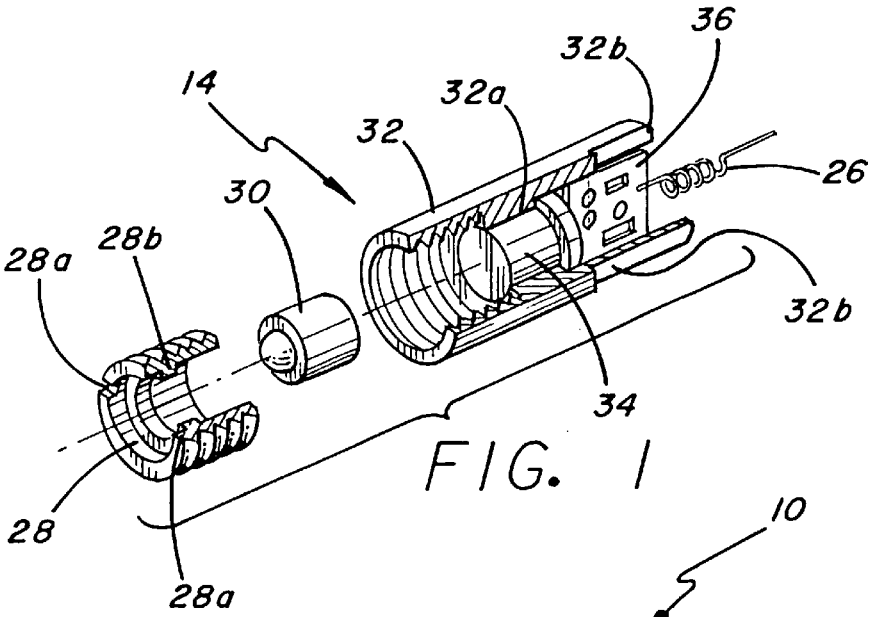
FIG. 1 is a partially exploded perspective view with parts broken away from a laser module for use in the device of FIG. 2.

Referring to FIG. 1, laser module 14 comprises lens holder 28, collimating lens 30, housing 32, laser diode 34, and laser diode driver circuit 36. Lens holder 28 has a generally tubular external shape with a threaded surface. A lip 28*b* is provided on an interior surface of lens holder 28 against which collimating lens 30 rests. A pair of opposing notches 28*a* are provided in a front portion of lens holder 28 for screwing lens holder 28 into matching internal threads of laser module housing 32. Any conventional technique may be used to make lens holder 28 from any rigid material such as brass, steel, plastic, and aluminum. Collimating lens 30 is a commercially available 4 mm diameter plastic lens, though the size of and material used for collimating lens 30 may be altered, if desired.

Laser module housing 32 has a generally tubular external shape, and an internally threaded recess for receiving lens holder 28. Laser module housing 32 also includes a mechanical stop 32*a* for laser diode 34. Laser module housing 32 also includes a pair of opposing notches 32*b* for moving the laser module 14 during alignment. Any conventional technique may be used to make laser module housing 32 using any rigid conductive material such as brass. Any commercially available laser diode 34 and driver circuit 36 may be used.

Figure 8:
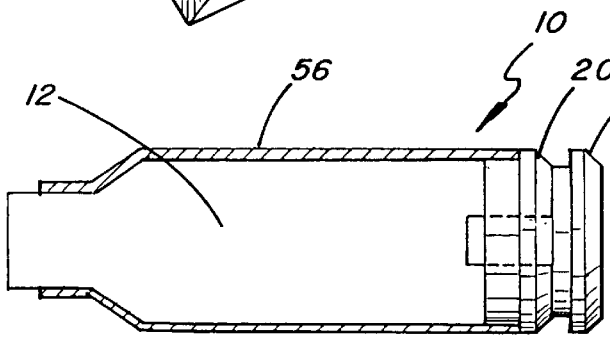
FIG. 8 is a simplified cross-sectional view of the device with an outer sleeve for adjusting the device's outer dimensions to match those required by the firearm.

In FIG. 8, an outer sleeve 56 is shown coupled to device 10. The purpose of outer sleeve 56 is to expand the effective outer dimensions of device 10 such that it may be used with firearms using a round of larger caliber than that for device 10 without the inclusion of outer sleeve 56. Regardless of whether or not outer sleeve 56 is used, the structure and operation of device 10 is as described herein, though outer sleeve 56 is made with a conductive material, such as brass.

Assembly of laser module 14 involves inserting collimating lens 30 into lens holder 28 such that the front edge of lens 30 abuts the interior surface of lip 28*b*. Collimating lens 30 is attached using any commercially available adhesive or adhering technique, such as press fitting. The laser diode 34, driver circuit 36, and spring 26 are typically prefabricated into a combined unit by the manufacturer. The combined unit is inserted and attached to the interior surface of the laser module housing 32 using a commercially available conductive adhesive, taking care to abut the laser diode 34 against mechanical stop 32*a*. The lens holder 28 (and collimating lens 30) are then screwed into the laser module housing 32, making use of the notches 28*a*. The laser diode 34 is energized and the lens holder 28 rotated to focus the laser beam in a well known manner. With the laser module 14 assembled and focused, it may be filled with a commercially available non-conductive epoxy.

Figure 5:
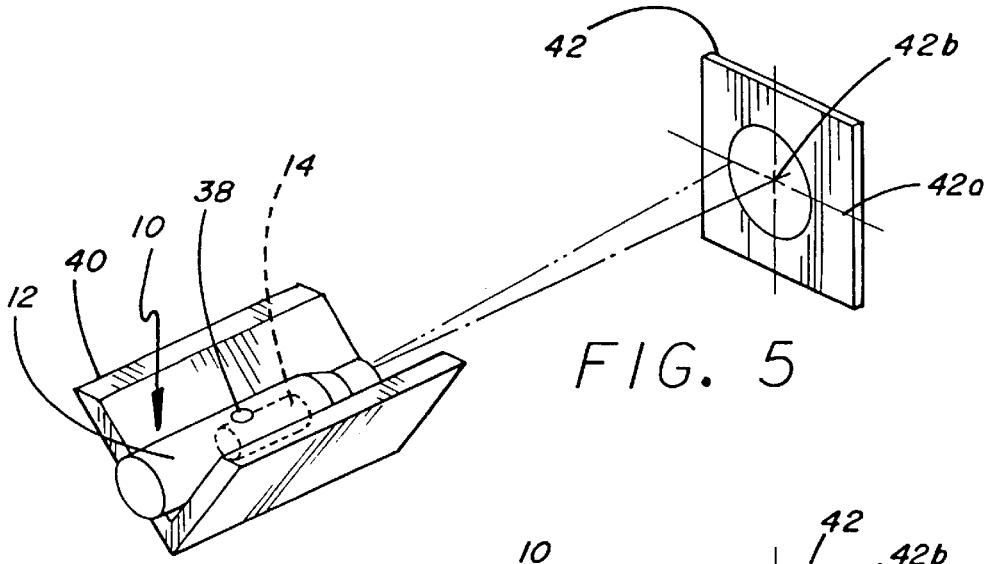
FIG. 5 is a perspective view of the device of the present invention resting in a support, and emitting a laser beam against a target for use in aligning the laser module.

In order to align laser module 14, a target 42 is set up at a desired distance (e.g., 100–200 feet) from support 40, as shown in FIG. 5. Target 42 includes a visible center point 42*b* (e.g., a one-inch diameter target spot) that has been pre-aligned with support 40 in a well known manner. This means that a properly focused and aligned laser module, when energized and placed in support 40, would produce a laser beam spot within the desired visible center point 42*b* of target 42.

Figure 4:
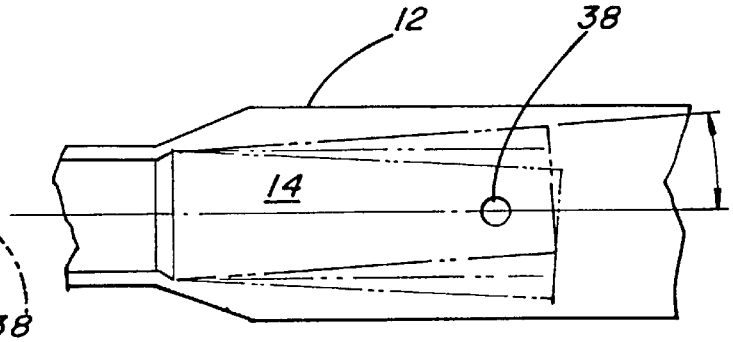
FIG. 4 is a partial plan view of the device of the present invention.

Now, housing 12 is secured in place on support 40 using a clamp, one's own hands, or any other suitable technique such that aperture 38 faces upward, as shown in FIG. 5. The housing's internal cavity is positioned such that when it receives laser module 14, the laser module's range of motion is restricted to two possibilities. First, laser module 14 may be rotated about its own axis (i.e., axial rotation about the laser beam). Second, laser module 14 may be swept in a linear motion, which defines a locus of points along the laser beam axis comprising a single plane. The sweeping linear motion of laser module 14 is depicted in the phantom line portions of FIGS. 2 and 4. With housing 12 secured, as noted above, this single plane is substantially coplanar with the horizontal axis 42*a* depicted on target 42 in FIG. 5.

Figure 6:
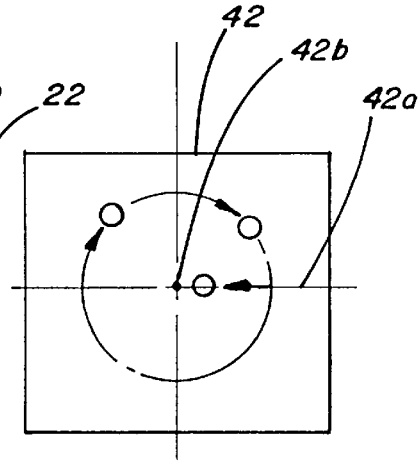
FIG. 6 is a plan view showing a pattern of laser beam contact against the target for use in aligning the laser module.

Laser module 14 is inserted into housing 12 until its front edge abuts location 12*b*, as depicted in FIGS. 2 and 5. Laser module 14 is energized using conventional techniques. A tool, inserted into notches 32*b* in the back-end of laser module housing 32, is used to rotate housing 32. As represented in FIG. 6, this causes a laser beam spot to hit target 42 and rotate as housing 32 rotates. When the laser beam spot intersects the horizontal axis 42*a* on target 42, rotation of laser module housing 32 is stopped. Still with reference to FIG. 6, laser module housing 32 is then moved (within the confines of the internal cavity of housing 12) in a linear sweeping motion until the laser beam spot intersects with the center 42*b* of target 42, indicating that laser module 14 is in the desired, aligned position.

An adhesive is applied to fix laser module 14 in the desired, aligned position. The adhesive may be applied through aperture 38 or through the back-end opening of housing 12. One or more spot welds may alternatively or additionally be implemented to fix the position of laser module 14 relative to housing 12. Also, an epoxy may be used to fill the void in between laser module 14 and the interior surface of housing 12.

To complete assembly of device 10, insulator 18 is inserted through the back-end opening in housing 12, and power supply 16 is likewise inserted. Back-end insulator 20 is screwed in place, as is back-end cap 22 with its associated spring 24. If a firearm 44 of caliber larger than that corresponding to device 10 is used, then an outer sleeve 56 of appropriate dimension is attached in any conventional manner to device 10.

In operation, device 10 is inserted into a chamber of firearm 44 where a round typically resides prior to firing, and firearm 44 is put into a "locked and loaded" condition. In this state, the firearm's bolt head, ejector, or like conductive parts will make physical and electrical contact in between back-end cap 22 and housing 12, typically in proximity to location 12*d*. It should be noted that certain terminology may vary from one firearm to the next. For example, the names for internal components (e.g., bolt head or ejector) and states of operability (e.g., "locked and loaded") may be different for various firearms; however regardless of the terminology used, in some state of operation a conductive part of the subject firearm will make physical and electrical contact in between back-end cap 22 and housing 12.

In this condition, an electrical circuit is established including a conductive part of firearm 44 through which electrical current flows to energize laser module 14. Specifically and with reference to FIG. 2, one electrode of power supply 16 is electrically coupled through spring 26 to laser diode driver circuit 36. The other electrode of power supply 16 is electrically coupled to spring 24, back-end cap 22, the conductive part or parts of firearm 44, housing 12, and laser module housing 32 to laser diode 34 to complete the circuit. The conductive part or parts of firearm 44 may include a bolt head, an ejector, a barrel, or any other conductive part of firearm 44.

With the laser beam now emerging from a focused, aligned laser module 14, the user may put the laser beam spot on target 42, and then align the firearm's scope or sight 46 in a well known manner.

Up to this point, the housing 12 has been shown and described as resembling the external shape of a round. Even when the outer sleeve 56 is coupled to the device 10, as depicted in FIG. 8, the housing 12 is described and depicted as such. However, in alternative embodiments, depicted more particularly in FIGS. 9 and 10, the housing 12' is not so shaped. Rather, in these alternative embodiments, the housing 12' is shaped in any one of a myriad of external cross sectional shapes, both circular and non-circular. An outer sleeve 56', made of a conductive material (e.g., brass), is coupled to the housing 12' to give the device 10 an external, round-resembling shape.

Figure 9:
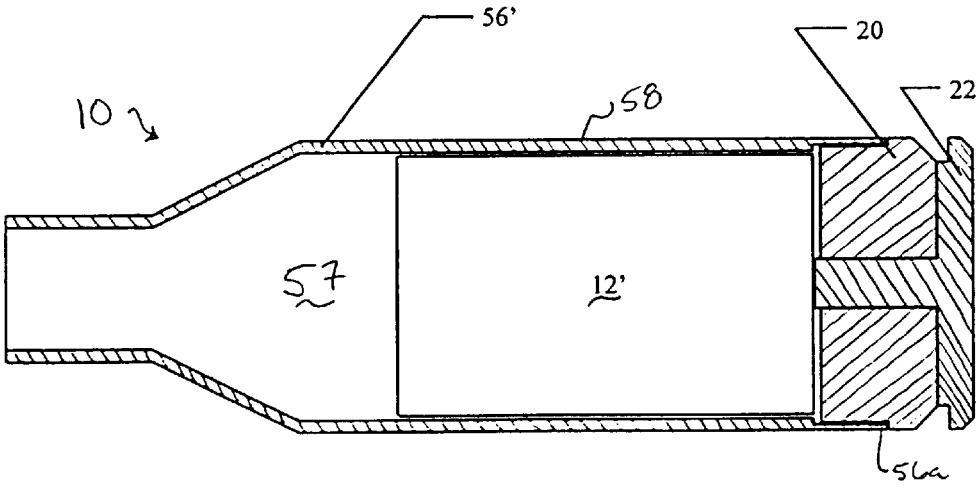
FIG. 9 is a simplified cross-sectional view of the device according to a first alternative embodiment of the present invention.
Figure 10:
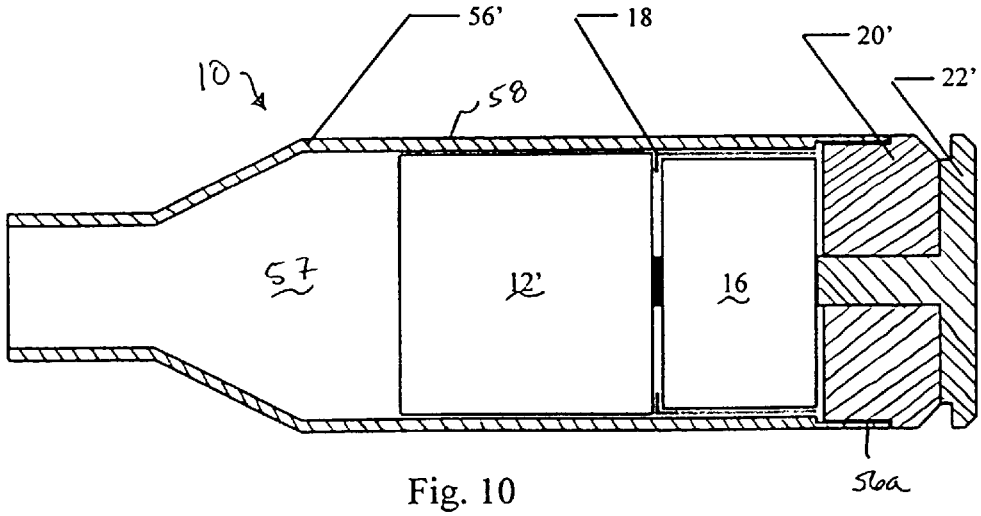
FIG. 10 is a simplified cross-sectional view of the device according to a second alternative embodiment of the present invention.

More particularly, and with reference to either, or both, FIGS. 9 and 10, the outer sleeve 56' includes an internal portion 57 and an external portion 58. The internal portion 57 is shaped and dimensioned to fit snugly around the housing 12', and the external portion 58, as just stated, is shaped and dimensioned to fit snugly within a chamber of the firearm 44. Thus, in these embodiments, the purpose of the outer sleeve 56' is two-fold. First, as with the embodiment depicted in FIG. 8, the outer sleeve 56' expands the effective outer dimensions of the device 10. And second, the outer sleeve 56' gives the device 10 its round-resembling shape. Although depicted as an integral structure, it will be appreciated that the outer sleeve 56' may be constructed of a plurality of sections, each of which are coupled to a portion of the housing 12'.

Turning now to the specific alternative embodiment depicted in FIG. 9, the housing 12', with the exception of its external shape, is constructed substantially similar to the housing 12 depicted in FIG. 2. However, the housing 12' and the internal portion 57 of the sleeve 56' are dimensioned such that the back-end insulator 20 and back-end cap 22 extend, at least partially, from a back end opening **56*a* in the sleeve 56'. Thus, the overall device 10** of this alternative embodiment will operate similar to the previously described embodiments.

In the specific alternative embodiment depicted in FIG. 10, the power supply 16 is positioned within the sleeve 56', external to the housing 12'. In this instance, the internal construction of the housing 12' is similar to that depicted in FIG. 2, but includes only the laser module 14 therein. The back-end insulator 20 and the back-end cap 22 remain part of the overall housing 12' configuration. Thus, the laser module 14 is electrically connected to the back-end cap 22 by either a conductor, such as a wire or a spring, or by the threaded portion of the back-end cap 22 being manufactured to be of sufficient length to physically contact the laser module 14. The power supply 16 is retained within the sleeve 56' and, as with the embodiment depicted in FIG. 2, includes either its own outer insulating layer, or a separate insulating layer 18, to prevent the power supply from making electrical contact with the interior surface of the sleeve 56'. Similar to the device 10 depicted in FIG. 2, a second back-end insulator 20' threadedly engages the internal portion 57 of the sleeve 56', and includes a central cavity with internal threads for receiving a second back-end cap 22'. Electrical communication between the housing 12, power supply 16, and second back end cap 22', may be provided by springs, such as those depicted in FIG. 2 (e.g. reference numerals 24, 26) or by the threaded portion of the second back end cap 22' being of sufficient length to abut these components against one another. The device 10 of this particular alternative embodiment also operates similar to the previously described embodiments, wherein the laser module 14 does not operate until an electrically conductive flowpath is established between the second back-end cap 22' and the sleeve 56'.

It should be understood that the methods and apparatuses described above are only exemplary and do not limit the scope of the invention, and that various modifications could be made by those skilled in the art that would fall under the scope of the invention. For example, while the method for aligning the laser module has been disclosed herein for use in aligning a firearm's scope, it is understood that the laser module alignment method is not limited to this field of use.

To apprise the public of the scope of this invention, the following claims are provided:

What is claimed:

1. A device facilitating adjustment of a sight on each of a variety of firearms having different calibers by providing a visible mark on a target when the device is placed within a chamber of any of the firearms, said device comprising:

a) a housing;

b) a laser module energizeable within the housing to produce the mark at a position along a laser axis extending through the firearm's barrel;

c) a power supply situated within the housing to energize the laser module; and d) a first sleeve selected from a plurality of differently sized sleeves, the first sleeve fitting snugly around at least a portion of the housing, and having an external shape sized to fit snugly within a chamber of predetermined caliber for one of the firearms.

2. The device of claim 1, wherein each additional one of the plurality of sleeves, when placed in turn around at least a portion of the housing, expands an outer dimension of the device to fit snugly within the chamber of a different caliber firearm.

3. The device of claim 1, wherein an outer periphery of the housing has a non-circular cross-sectional shape.

4. A device facilitating adjustment of a sight on each of a variety of firearms having different calibers by providing a visible mark on a target when the device is placed within a chamber of any of the firearms, said device comprising:

a) a housing;

b) a laser module energizeable within the housing to produce the mark at a position along a laser axis extending through the firearm's barrel;

c) a first sleeve selected from a plurality of differently sized sleeves, the first sleeve fitting snugly around at least a portion of the housing, and having an external shape sized to fit snugly within a chamber of predetermined caliber for one of the firearms; and d) a power supply situated within the first sleeve and electrically coupled to the laser module.

5. The device of claim 4, wherein each additional one of the plurality of sleeves, when placed in turn around at least a portion of the housing, expands an outer dimension of the device to fit snugly within the chamber of a different caliber firearm.

6. The device of claim 4, wherein an outer periphery of the housing has a non-circular cross-sectional shape.

7. The device of claim 1, wherein the housing has an external shape that does not resemble a firearm round.

8. The device of claim 1, wherein the laser module is permanently affixed to the housing.

9. The device of claim 8, wherein the laser module is permanently affixed to the housing using an epoxy.

10. The device of claim 4, wherein the housing has an external shape that does not resemble a firearm round.

11. The device of claim 4, wherein the laser module is permanently affixed to the housing.

12. The device of claim 11, wherein the laser module is permanently affixed to the housing using an epoxy.

* * * * *